US008375619B2

(12) United States Patent
Hewes

(10) Patent No.: US 8,375,619 B2
(45) Date of Patent: Feb. 19, 2013

(54) INCREMENTALLY ADJUSTABLE SIGHT

(75) Inventor: David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 191 days.

(21) Appl. No.: 13/030,524

(22) Filed: Feb. 18, 2011

(65) Prior Publication Data

US 2011/0308132 A1 Dec. 22, 2011

Related U.S. Application Data

(60) Provisional application No. 61/305,625, filed on Feb. 18, 2010.

(51) Int. Cl.
*F41G 1/033* (2006.01)
*F41G 1/16* (2006.01)

(52) U.S. Cl. ..... 42/136

(58) Field of Classification Search ..... 42/135, 42/136, 111, 122; 33/297, 298
See application file for complete search history.

(56) References Cited

U.S. PATENT DOCUMENTS

| | | | | | |
|---|---|---|---|---|---|
| 1,122,115 | A | * | 12/1914 | Hill | 42/136 |
| 1,330,002 | A | * | 2/1920 | Price | 42/136 |
| 1,572,294 | A | * | 2/1926 | King | 42/136 |
| 3,270,418 | A | * | 9/1966 | Simeone et al. | 42/136 |
| 4,574,335 | A | * | 3/1986 | Frimer | 362/84 |
| 5,966,825 | A | * | 10/1999 | Biemont | 42/136 |
| 6,886,289 | B1 | * | 5/2005 | Rigler | 42/136 |

* cited by examiner

*Primary Examiner* — Michael Carone
*Assistant Examiner* — Reginald Tillman, Jr.
(74) *Attorney, Agent, or Firm* — Parsons & Goltry; Robert A. Parsons; Michael W. Goltry

(57) ABSTRACT

An incrementally adjustable sight for a firearm is taught. The sight includes a base attachable to a firearm and a housing carried by the base. The housing includes a central cavity having an opening and carrying a sight post assembly. The sight post assembly includes a sight post having a first end extending outwardly from the central cavity through the opening and a second end. A cam follower and a cam member are carried by the sight post with the cam member, cammingly engaging the cam follower between a plurality of positions. A biasing member biases the first end of the sight post away from one of the cam follower and the cam member a distance. The distance is adjusted by relative movement of the cam member and the cam follower between the plurality of positions.

19 Claims, 6 Drawing Sheets

INCREMENTALLY ADJUSTABLE SIGHT

CROSS-REFERENCE TO RELATED APPLICATION

This application claims the benefit of U.S. Provisional Application No. 61/305,625, filed 18 Feb. 2010.

FIELD OF THE INVENTION

This invention relates to firearm accessories.

More particularly, the present invention relates to sights for firearms.

BACKGROUND OF THE INVENTION

In the field of firearms, sights are numerous and varied but are used for a single purpose. A sight system is intended to put a bullet on a target. Sight systems include, in a basic form, a rear sight and a front sight. Lining up the front sight with the rear sight is intended to determine the striking position of the bullet. However, there are added factors complicating this simple process. The distance the bullet must travel will cause a deviation from the designated target. In other words, a front and rear sight can be adjusted to deliver a bullet on target at a specific distance. A greater distance will result in a low bullet strike. This deviation can be accounted for by adjusting the front or rear sight relative the other. However, adjustable sights require that the sight be tested as adjusted to determine the appropriate amount of adjustment.

It would be highly advantageous, therefore, to remedy the foregoing and other deficiencies inherent in the prior art.

SUMMARY OF THE INVENTION

Briefly, to achieve the desired objects and advantages of the instant invention provided is an incrementally adjustable sight. The sight includes a base attachable to a firearm and a housing carried by the base. The housing includes a central cavity having an opening. A sight post assembly is carried by the housing within the central cavity. The sight post assembly includes a sight post having a first end extending outwardly from the central cavity through the opening and a second end. A cam follower and a cam member are carried by the sight post with the cam member cammingly engaging the cam follower between a plurality of positions. A biasing member biases the first end of the sight post away from one of the cam follower and the cam member a distance. The distance is adjusted by relative movement of the cam member and the cam follower between the plurality of positions.

In a specific aspect, further provided is a knob with the cam follower formed on a lower surface thereof. The knob includes a central aperture receiving the sight post therethrough along an axis of the aperture for controlled longitudinal movement of the knob along the axis. The cam member is immovably attached to the sight post at the second end. The biasing member biases the first end of the sight post away from the cam follower along the axis and thereby biases the cam member against the cam follower.

Also provided is a firearm having an incrementally adjustable sight including a firearm and a base attachable to the firearm. A housing is carried by the base, defining a central cavity and having a top opening in communication with the central cavity. A knob having a central aperture defining an axis, and a bottom surface defining a cam follower, is carried within the central cavity and held immovable in a direction along the axis and rotatable about the axis. A sight post having a first end extending outwardly from the central cavity through the top opening and a second end extending into the central cavity through the central aperture of the knob, along the axis is provided. A cam member is attached proximate the second end of the sight post, cammingly engaging the cam follower between a plurality of positions. A biasing member biases the first end of the sight post away from the cam follower a distance along the axis, and thereby biases the cam member against the cam follower. The distance is adjusted by relative movement of the cam member and the cam follower between the plurality of positions.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENTS

Figure 1A:
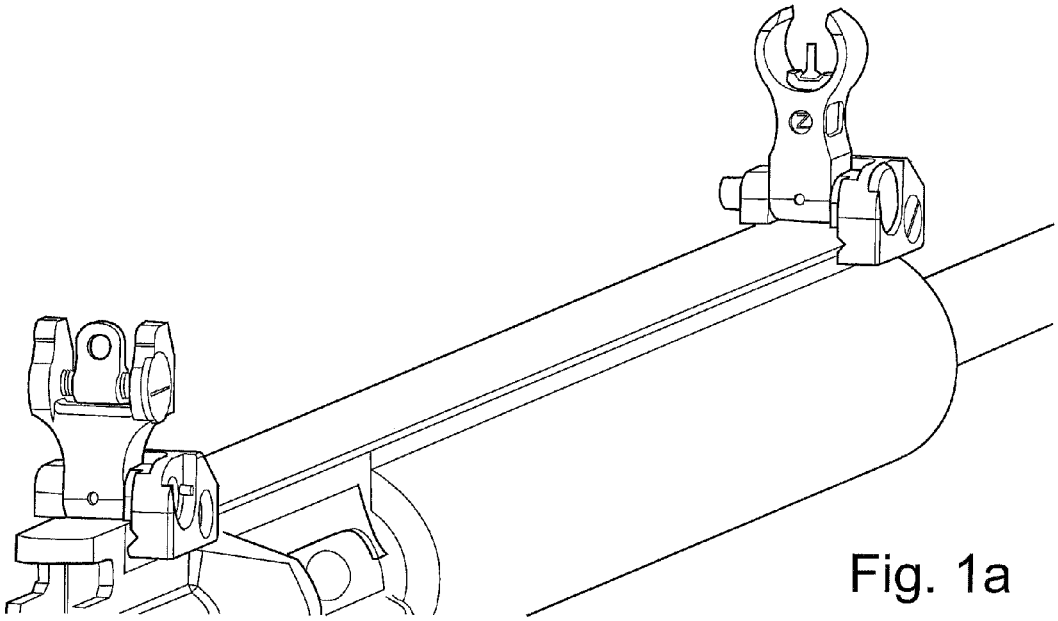
FIG. 1*a* is a partial perspective view of an incrementally adjustable sight according to the present invention, mounted on a firearm as a front sight.
Figure 1B:
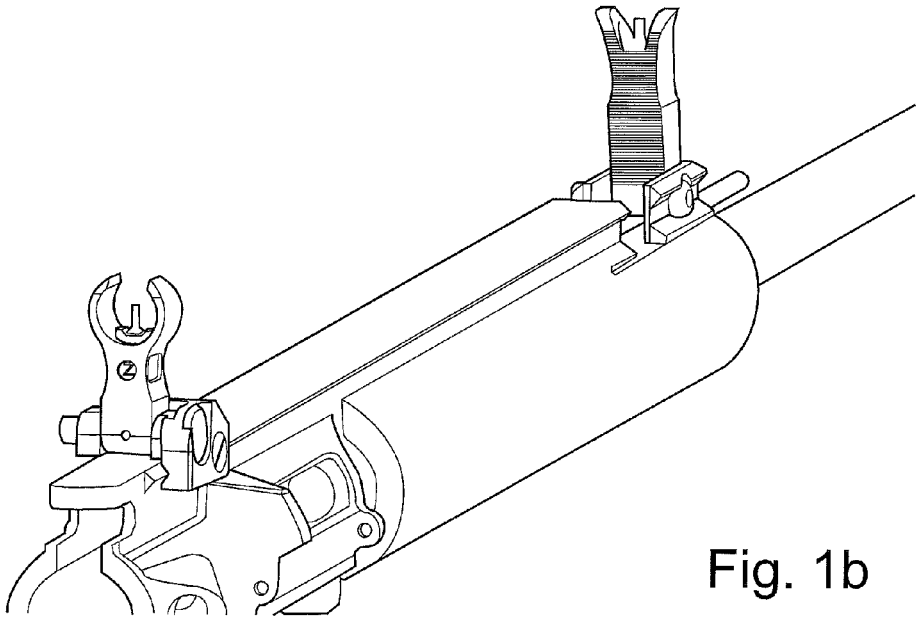
FIG. 1*b* is a partial perspective view of an incrementally adjustable sight according to the present invention, mounted on a firearm as a rear sight.

Turning now to the drawings in which like reference characters indicate corresponding elements throughout the several views, attention is first directed to FIGS. 1*a* and 1*b*, which illustrate a firearm 5 having a receiver 6 with a rail 7. A front sight is mounted on rail 7 forwardly, toward a muzzle end of firearm 5, and a rear sight is mounted on rail 7 rearwardly, toward receiver 6. Incrementally adjustable sight 10 is employed as a front sight in FIG. 1*a*, and as a rear sight in FIG. 1*b*.

Figure 2:
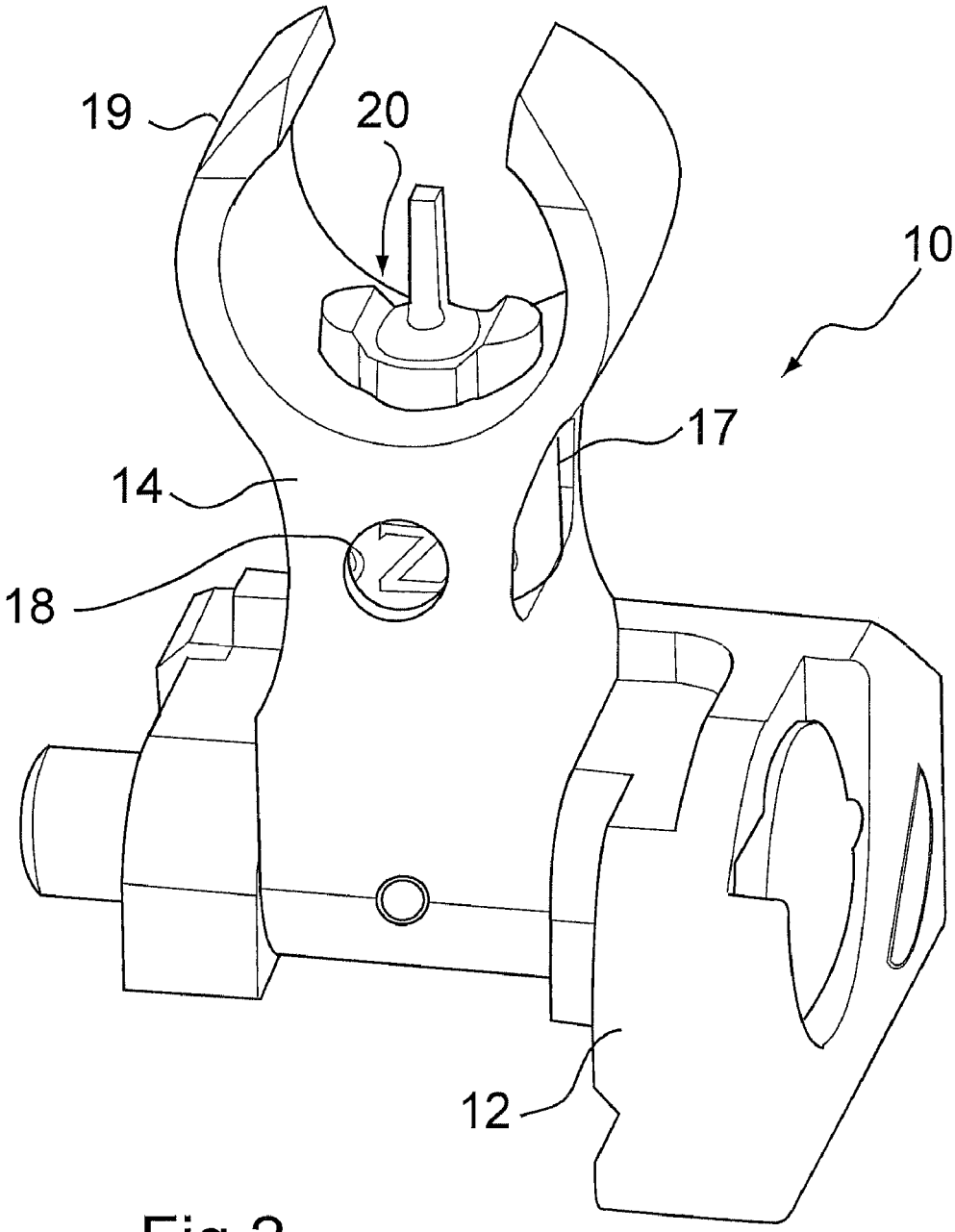
FIG. 2 is a perspective view of an incrementally adjustable sight according to the present invention.

Turning now to FIG. 2, incrementally adjustable sight 10 is illustrated. Incrementally adjustable sight 10 is couplable (mounted) toward the front end of a firearm as a front sight and used in combination with a rear sight, or couplable (mounted) toward the rearward end of a firearm as a rear sight and used in combination with a front sight (FIG. 1). As will be described presently, incrementally adjustable sight 10 is adjustable in pre-determined increments to adjust a firearm from a set zero (zeroed in) adjustment to multiple different ranges with the turn of a knob and with no additional sighting required. Incrementally adjustable front sight 10 includes a base 12 pivotally carrying a housing 14. While base 12 is configured to be mountable to the rail of a receiver or handguard, it will be understood that the base could be fixedly or removably coupled to a firearm in other manners. Housing 14 includes a central cavity having an opening 15 extending upwardly, opposing access openings 17 formed through opposing sides of housing 14, and a window opening 18 formed in a rear surface of housing 14. Housing 14 includes upwardly directed framing elements 19 defining a window above opening 15. A sight post assembly 20 is carried by housing 14 and extends upwardly through opening 15, framed centrally by framing elements 19.

Figure 3:
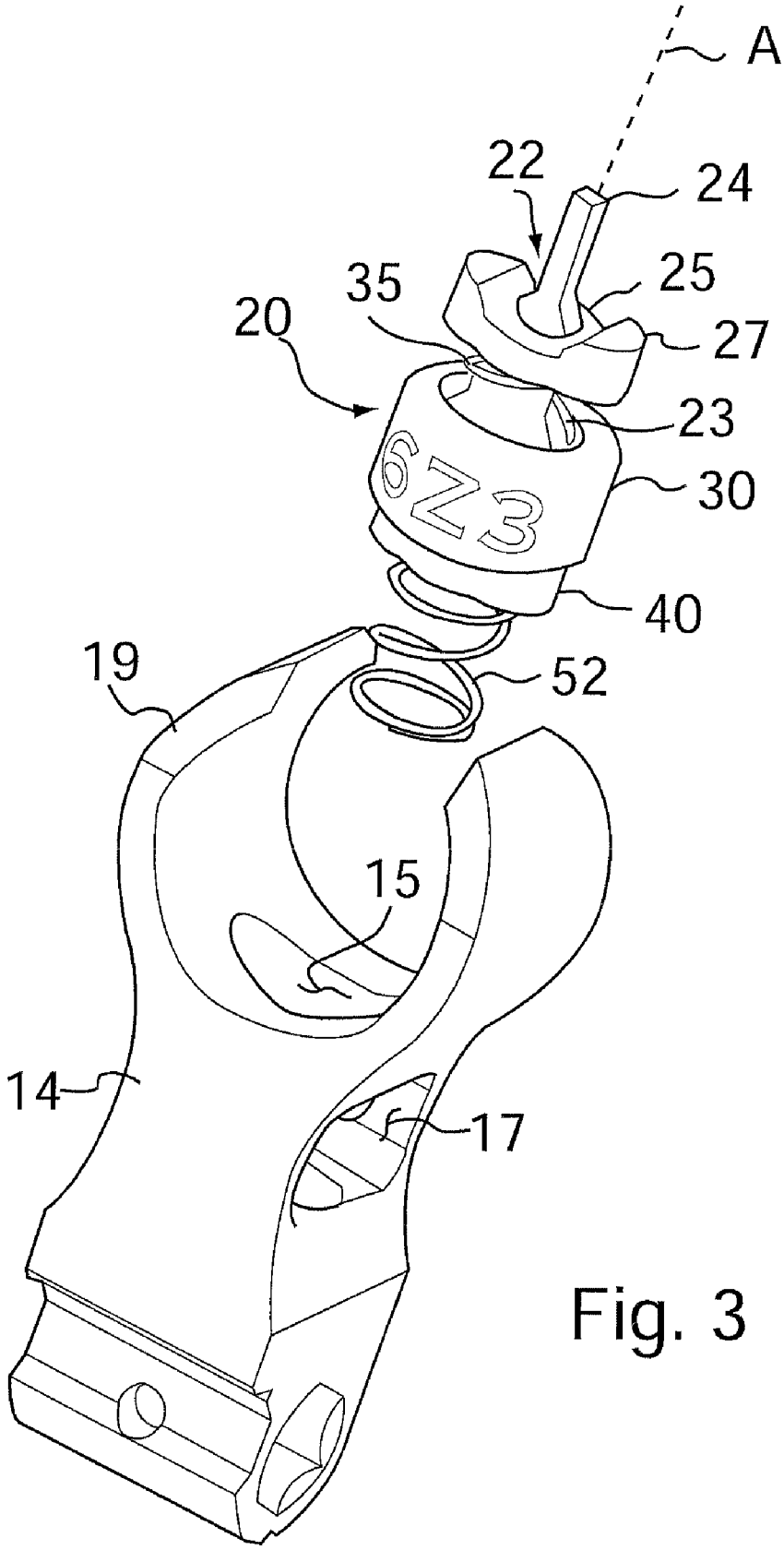
FIG. 3 is an exploded view of the incrementally adjustable sight.
Figure 4:
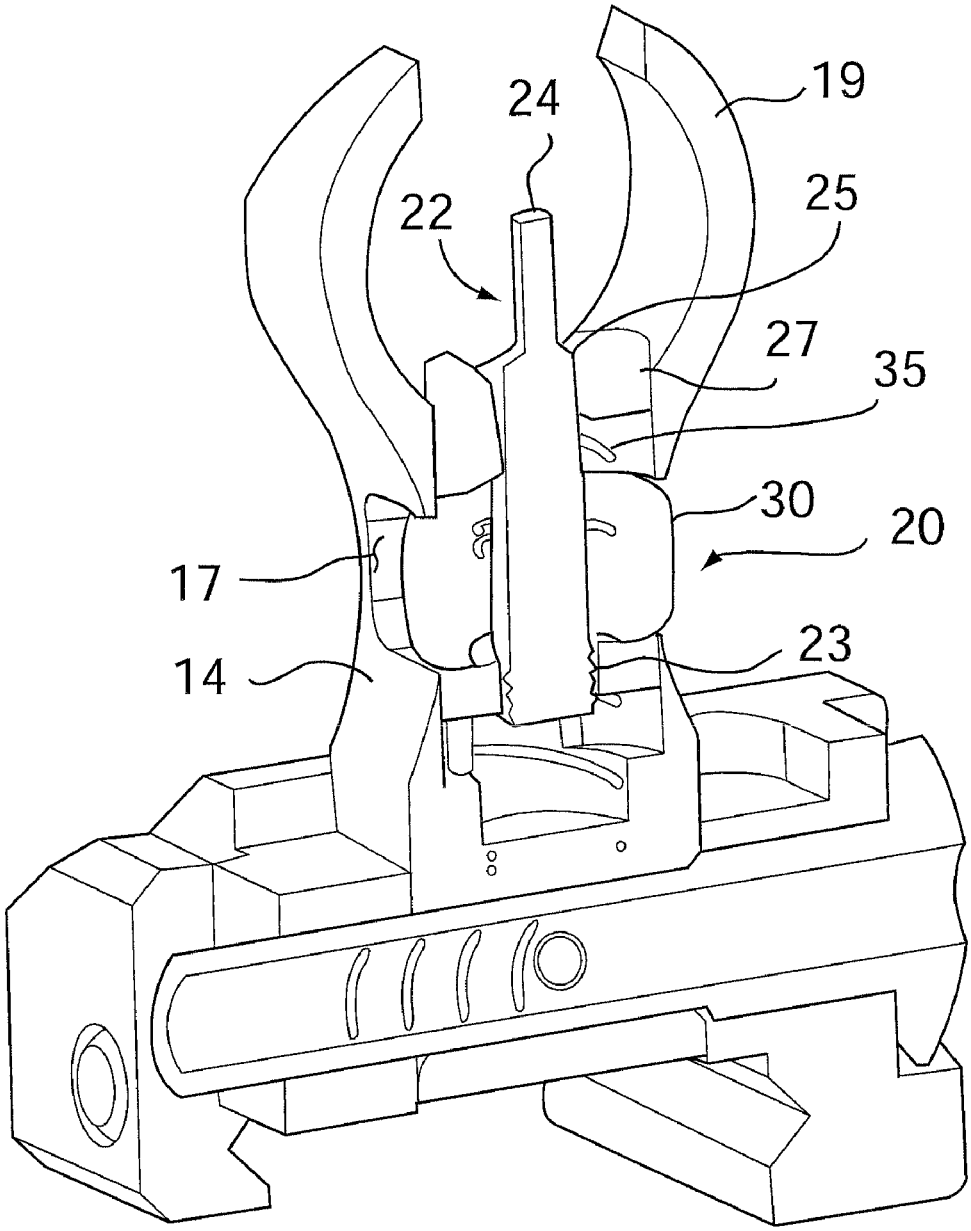
FIG. 4 is a sectional view of the incrementally adjustable sight.

Turning now to FIGS. 3 and 4, sight post assembly 20 includes a sight post 22 having a threaded base 23, an opposing sight end 24 and a radially outwardly extending flange 25 intermediate threaded base 23 and sight end 24. Sight post assembly 20 further includes a guide member 27 received by sight post 22 and engaging the lower side of flange 25. A knob 30, having a central aperture 32 and an outer periphery 33 (see FIG. 5), is carried within the cavity with outer periphery 33 accessible through access openings 17. Knob 30 is held immovable in the vertical direction, but rotatable about a vertical axis A for purposes which will be described presently. Threaded end 23 of sight post 22 is received through central aperture 32 of knob 30. A compression coil spring 35 is carried about sight post 22 between knob 30 and guide member 27, biasing guide member 27 against flange 25 and forcing sight post 22 upward. The upward movement of sight post 22 is controlled by a cam member 40. Cam member 40 has a threaded central aperture 42 (See FIG. 6) threadably engaging threaded base 23 of sight post 22. Thus, the upper surface of cam member 40 engages a lower surface of knob 30. When cam member 40 is pulled tightly against knob 30 by the bias of spring 35 forcing sight post 22 upwardly away from knob 30, that upward movement is curtailed. The exact distance sight end 24 is moved upwardly or downwardly relative knob 30 is determined by the interaction of the upper surface of cam member 40 and the lower surface of knob 30.

Figure 5:
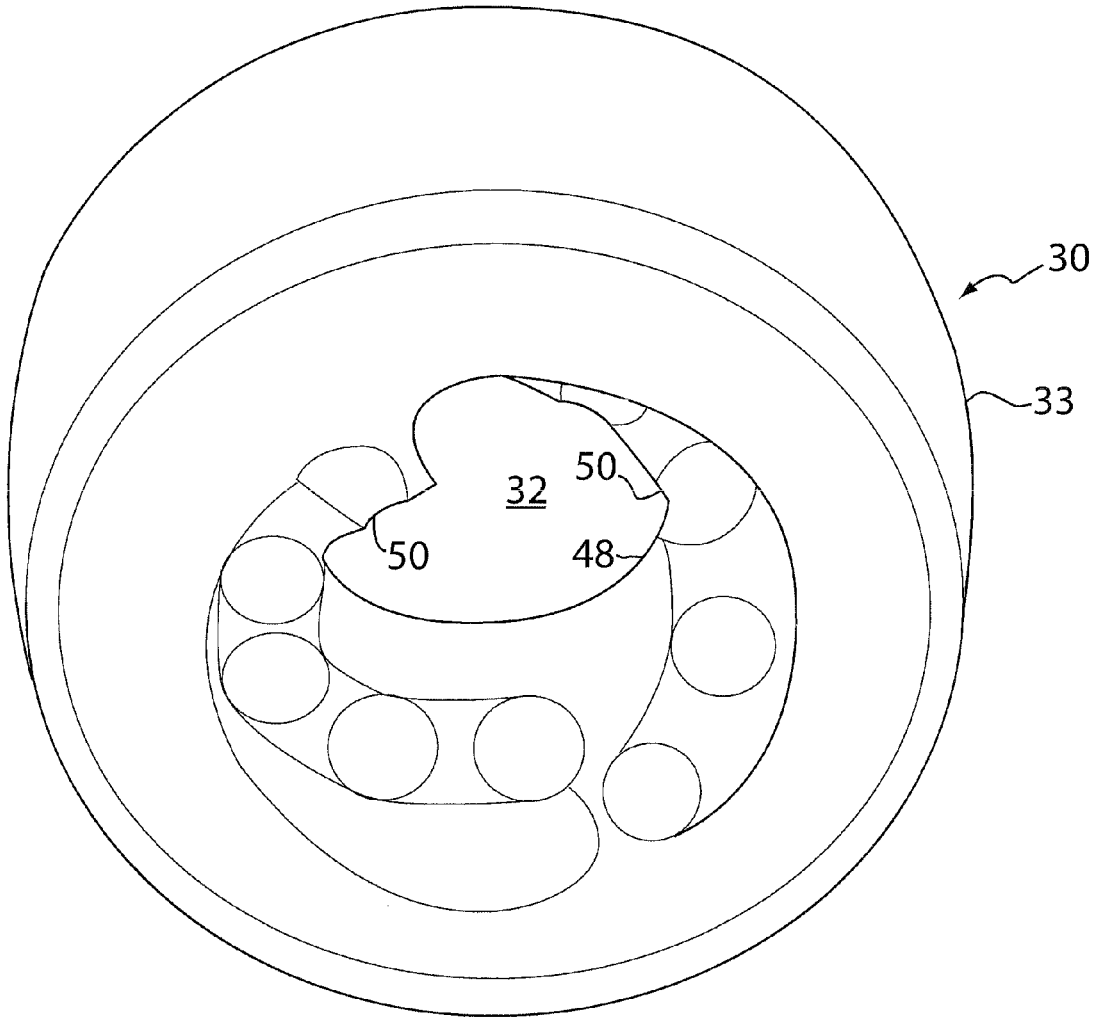
FIG. 5 is a perspective view of the adjustment knob of the incrementally adjustable sight.
Figure 6:
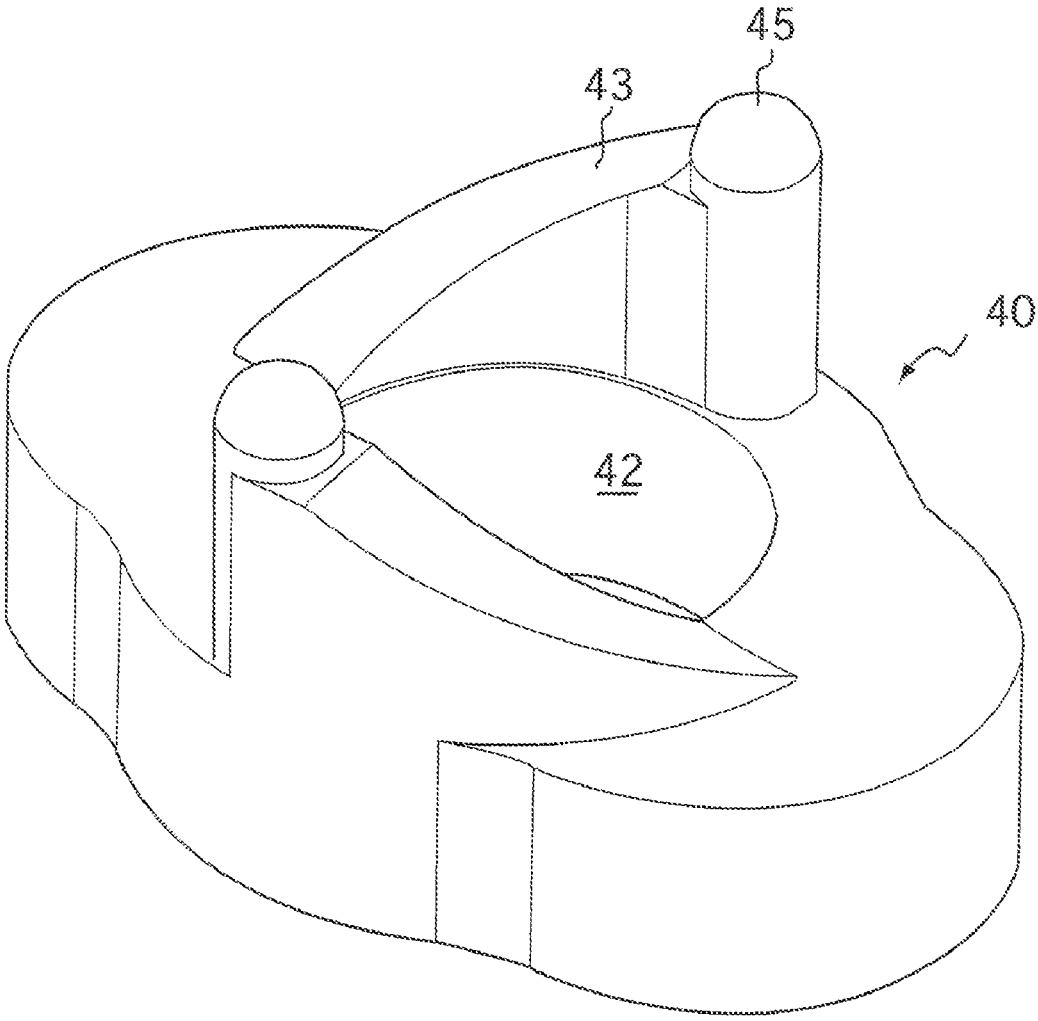
FIG. 6 is a perspective view of the cam element of the incrementally adjustable sight.

With additional reference to FIGS. 5 and 6, cam member 40 includes the upper surface having camming surfaces 43 terminating in cam posts 45, formed thereon. Camming surfaces 43 and cam posts 45 engage cam follower surfaces 48 formed on the lower surface of knob 40. Cam follower surfaces 48 slope from proximate the lower surface of knob 30 toward the upper surface thereof. Cam follower surfaces 48 include specifically positioned indentations 50 for receiving and anchoring cam posts 45. Indentations 50 are specifically positioned sequentially along the cam follower surface 48 and increase in depth concurrent with the slope of surface 48. Thus, the exact position of cam member 40 with respect to knob 30 can be adjusted, thereby adjusting the distance sight post end 24 is from knob 30. The shape of indentations 50 securely hold cam member 40 in position relative knob 30, but can be overcome by manual force to turn knob 30 relative cam member 40 changing cam posts 45 to different indentations. The depth of the indentation relative the upper surface of knob 30 can be calibrated to position sight end 24 for specific ranges. For example, the sight is zeroed in at, for example 200 yards. Turn of the knob to 3 will adjust the sight to 300 yards. Turning the knob to 4-6, will adjust the sight to 200-600 yards, respectively. It will be understood that any ranges and increments can be used. A second compression spring 52 is positioned between the bottom of the cavity, against housing 14, and the lower surface of cam member 40, forcing cam member 40 upwardly against knob 30 and helping secure sight post assembly in position.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. An incrementally adjustable sight comprising:
a base attachable to a firearm;
a housing carried by the base, the housing including a central cavity having an opening; and
sight post assembly carried by the housing within the central cavity, the sight post assembly including:
a sight post having a first end extending outwardly from the central cavity through the opening and a second end;
a cam follower carried by the sight post;
a cam member carried by the sight post and cammingly engaging the cam follower between a plurality of positions; and
a biasing member biasing the first end of the sight post away from one of the cam follower and the cam member a distance, the distance adjusted by relative movement of the cam member and the cam follower between the plurality of positions.

2. An incrementally adjustable sight as claimed in claim 1 wherein the housing further includes upwardly directed framing elements framing the first end of the sight post.

3. An incrementally adjustable sight as claimed in claim 1 wherein the cam follower is formed on a lower surface of a knob, and the knob includes a central aperture receiving the sight post therethrough along an axis of the aperture for controlled longitudinal movement of the knob along the axis, and the cam member is immovably attached to the sight post at the second end.

4. An incrementally adjustable sight as claimed in claim 3 wherein the biasing member biasing the first end of the sight post away from the cam follower along the axis and thereby biases the cam member against the cam follower.

5. An incrementally adjustable sight as claimed in claim 4 wherein the sight post includes a radially outwardly extending flange intermediate the first end and the second end for receiving the bias from the biasing member.

6. An incrementally adjustable sight as claimed in claim 5 wherein the sight post assembly further includes a guide member received by the sight post and engaging a lower side of the flange for guiding movement of the sight post longitudinally along the axis.

7. An incrementally adjustable sight as claimed in claim 1 wherein the cam member includes an upper surface having camming surfaces terminating in cam posts formed thereon.

8. An incrementally adjustable sight as claimed in claim 7 wherein the cam follower includes sloping surfaces having indentations for receiving and anchoring the cam posts.

9. An incrementally adjustable sight as claimed in claim 8 wherein the indentations are specifically positioned sequentially along the sloped surface of the cam follower and increase in depth concurrent with the slope of the sloped surface.

10. An incrementally adjustable sight comprising:
a base attachable to a firearm;
a housing carried by the base, the housing defining a central cavity and having a top opening in communication with the central cavity;
a knob having a central aperture defining an axis, an outer periphery, and a bottom surface defining a cam follower, the knob carried within the central cavity and held immovable in a direction along the axis and rotatable about the axis;
a sight post having a first end extending outwardly from the central cavity through the top opening and a second end extending into the central cavity through the central aperture of the knob, along the axis;

a cam member attached proximate the second end of the sight post and cammingly engaging the cam follower between a plurality of positions; and a biasing member biasing the first end of the sight post away from the cam follower a distance along the axis, and thereby biasing the cam member against the cam follower, the distance adjusted by relative movement of the cam member and the cam follower between the plurality of positions.

11. An incrementally adjustable sight as claimed in claim 10 wherein the sight post includes a radially outwardly extending flange intermediate the first end and the second end for receiving the bias from the biasing member.

12. An incrementally adjustable sight as claimed in claim 11 further including a guide member received by the sight post and engaging a lower side of the flange for guiding movement of the sight post longitudinally along the axis.

13. An incrementally adjustable sight as claimed in claim 10 wherein the cam member includes an upper surface having camming surfaces terminating in cam posts formed thereon.

14. An incrementally adjustable sight as claimed in claim 13 wherein the cam follower includes sloping surfaces having indentations for receiving and anchoring the cam posts.

15. An incrementally adjustable sight as claimed in claim 14 wherein the indentations are specifically positioned sequentially along the sloped surface of the cam follower and increase in depth concurrent with the slope of the sloped surface.

16. A firearm having an incrementally adjustable sight comprising:

a firearm;

a base attachable to the firearm;

a housing carried by the base, the housing defining a central cavity and having a top opening in communication with the central cavity;

a knob having a central aperture defining an axis, and a bottom surface defining a cam follower, the knob carried within the central cavity and held immovable in a direction along the axis and rotatable about the axis;

a sight post having a first end extending outwardly from the central cavity through the top opening and a second end extending into the central cavity through the central aperture of the knob, along the axis;

a cam member attached proximate the second end of the sight post and cammingly engaging the cam follower between a plurality of positions; and a biasing member biasing the first end of the sight post away from the cam follower a distance along the axis, and thereby biasing the cam member against the cam follower, the distance adjusted by relative movement of the cam member and the cam follower between the plurality of positions.

17. A firearm having an incrementally adjustable sight as claimed in claim 16 wherein the cam member includes an upper surface having camming surfaces terminating in cam posts formed thereon.

18. A firearm having an incrementally adjustable sight as claimed in claim 17 wherein the cam follower includes sloping surfaces having indentations for receiving and anchoring the cam posts.

19. A firearm having an incrementally adjustable sight as claimed in claim 18 wherein the indentations are specifically positioned sequentially along the sloped surface of the cam follower and increase in depth concurrent with the slope of the sloped surface.

* * * * *